US010842697B1

(12) United States Patent
Comunale

(10) Patent No.: US 10,842,697 B1
(45) Date of Patent: Nov. 24, 2020

(54) DISPOSABLE BIO-SECURE ENVIRONMENTAL UNIT

(71) Applicant: Mark E. Comunale, Temecula, CA (US)

(72) Inventor: Mark E. Comunale, Temecula, CA (US)

( * ) Notice: Subject to any disclaimer, the term of this patent is extended or adjusted under 35 U.S.C. 154(b) by 0 days.

(21) Appl. No.: 16/929,788

(22) Filed: Jul. 15, 2020

Related U.S. Application Data

(63) Continuation-in-part of application No. 14/756,979, filed on Nov. 4, 2015, now Pat. No. 10,716,725.

(60) Provisional application No. 62/993,288, filed on Mar. 23, 2020.

(51) Int. Cl.
*A61G 10/00* (2006.01)
*A61G 10/02* (2006.01)

(52) U.S. Cl.
CPC ..... *A61G 10/005* (2013.01); *A61G 2200/327* (2013.01); *A61G 2200/34* (2013.01); *A61G 2210/30* (2013.01)

(58) Field of Classification Search
CPC . A61G 1/04; A61G 10/02; A61G 7/05; A61G 10/005
See application file for complete search history.

(56) References Cited

U.S. PATENT DOCUMENTS

2004/0050008 A1* 3/2004 Mintie ..... E04H 1/1277 52/646
2006/0020159 A1* 1/2006 Ellen ..... A61G 10/005 600/21
2015/0218833 A1* 8/2015 Ballantyne ..... E04B 1/34384 52/79.1

* cited by examiner

*Primary Examiner* — Christine H Matthews
*Assistant Examiner* — Joshua Daryl D Lannu
(74) *Attorney, Agent, or Firm* — Morris Pollack; Luis Figarella

(57) ABSTRACT

A low cost, disposable bio-secure environment to temporarily hold, and where required to transport, patients who are suspected of having an infectious or contagious disease requiring contact, droplet and/or respiratory isolation precautions. The described Environmental Unit's unique design provides a unit that is disposable and relatively inexpensive. The frame is designed to integrate and adapt to various hospital stretchers and beds. The unit is large enough for a patient to sit up and allows movement of arms and legs and the ability to eat and drink while isolated on a bed.

13 Claims, 14 Drawing Sheets

DISPOSABLE BIO-SECURE ENVIRONMENTAL UNIT

CROSS-REFERENCE TO RELATED APPLICATIONS

This application is a Continuation in part of pending U.S. Non-Provisional patent application Ser. No. 14/756,979 "Disposable Bio-Secure Environmental Unit", filed on Nov. 4, 2015 and to U.S. Provisional patent application 62/993,288 "Disposable Bio-Secure Environmental Unit" filed on Mar. 23, 2020, the disclosure of both which is herein incorporated by reference in their entirety.

PATENTS CITED

The following documents and references are incorporated by reference in their entirety, Ellen (U.S. Pat. Appl. No. 2006/0020159), Fujimoro et al (U.S. Pat. No. 9,155,309), Hardin (U.S. Pat. No. 9,038,214), Yachi et al (U.S. Pat. No. 6,966,937) and Gauger et al (U.S. Pat. No. 6,321,764).

FIELD OF THE INVENTION

This invention relates to patients that are suspected of infectious and/or contagious disease; and, more particularly to such patients temporary isolation while being transported, seeking entrance to a hospital, clinic or doctor's office, and/or requiring an upgrade of isolation conditions within a facility.

DESCRIPTION OF THE RELATED ART

Many hospitals, clinics, doctor's offices, and other such facilities have found it necessary to screen for Ebola, COVID-19 and other contagious diseases. Once a patient seeking entrance to the facility says "yes" to screening questions, concerning Ebola and/or such other contagious diseases, the patient must be isolated in a negative pressure room and staff must don appropriate Personal Protective Equipment (PPE) and must have a place, such as an anteroom, available to dress and undress. At that time there also arises a need for a patient transport unit that facilitates transport of such a patient.

Patient isolation units, such as the one shown and described in U.S. Pat. No. 6,966,937 to Takashi Yachi, et al, require use of a sheet of flammable resin as part of an enclosure or tent within which a patient can be examined. The erection of the enclosure is time consuming. Its flammability may prove to be unacceptable and dangerous due to ifs flammability.

U.S. Pat. No. 9,038,214, issued on May 26, 2015, on the other hand, provides a plurality of privacy screens that are to be hung about a bed or gurney to accommodate HIPPA requirements. The illustrated and described screens are unacceptable because the patient cannot see out, nor can attending medical personnel see in or attend to the patient without displacing one or more of the screens.

U.S. Pat. No. 9,155,309, issued on Oct. 13, 2015 is directed to a virus inactivating sheet and would prove unacceptable for patients seeking entry to a medical facility.

What is needed, is a low cost, disposable bio-secure environment to temporarily hold, and where required to transport, patients who are suspected of having an infectious or contagious disease requiring contact, droplet and/or respiratory isolation precautions. With such a unit, upon initial presentation of such patients, health care facilities would be able to safely isolate such patients while they are initially assessed and then, if need be, transported to an appropriate biosafety level unit.

SUMMARY OF THE INVENTION

This section is for the purpose of summarizing some aspects of the present invention and to briefly introduce some embodiments. Simplifications or omissions may be made to avoid obscuring the purpose of the section. Such simplifications or omissions are not intended to limit the scope of the present invention.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e., that it will be taken to mean an inclusion of not only the listed components it directly references, but also other non-specified components or elements. This rationale will also be used when the term 'comprised' or 'comprising' is used in relation to one or more steps in a method or process.

In one aspect, the invention is about a disposable bio-secure environmental unit comprising a reusable support frame adjustable in length and/or width, a collapsible containment tent or enclosure having a ceiling, a bottom and at least four side panels forming a single pneumatic enclosure, said containment enclosure having one or more mechanical attach components along its length/width/height for coupling with said support frame, said containment enclosure having one or more resealable entry/exit/access openings and one or more battery powered negative pressure ventilators mechanically attached to said frame, one or more of said ventilators having pneumatic access to said containment enclosure's interior volume. In another aspect, said containment's enclosure resealable entry/exit opening extends along the side and top of one side panel of said enclosure, forming a flap when opened, so that said flap falls over the side when open; and said containment's enclosure includes one or more pairs of integrated sealed port gloves access points. In yet another aspect, said containment enclosure's internal height is approximately half said containment enclosure's internal length. In another aspect, said containment enclosure mechanical attach components are comprised of one or more of: Hooks and loops straps, ropes, clips, loops, carabiners clips and said adjustable frame length or width adjustment are comprised of one or more of: set screws, friction couplers, cotter pins or similar. In yet another aspect, one or more Hooks and loops straps are attached/bonded onto both the side wall and end wall of said enclosure. In another aspect, said frame is secured to a gurney, bed or surface.

In one aspect the invention is about method of using a disposable bio-secure environmental system, said method comprising providing a reusable support frame adjustable in length and/or width, installing a collapsible containment enclosure having a ceiling, a bottom and at least four side panels forming a single pneumatic enclosure, said containment enclosure having one or more mechanical attach components along its length/width/height for coupling with said support frame and wherein said containment enclosure has one or more resealable entry/exit/access openings as well as one or more battery powered negative pressure ventilators mechanically attached to said frame, one or more of said ventilators having pneumatic access to said containment enclosure's interior volume.

In another aspect, said containment's enclosure resealable entry/exit opening extends along the side and top of one side panel of said enclosure, forming a flap when opened, so that said flap falls over the side when open; and said containment's enclosure includes one or more pairs of integrated sealed port gloves access points. In yet another aspect, said containment enclosure's internal height is approximately half said containment enclosure's internal length. In another aspect, said containment enclosure mechanical attach components are comprised of one or more of: Hooks and loops straps, ropes, clips, loops, carabiners clips and said adjustable frame length or width adjustment are comprised of one or more of: set screws, friction couplers, cotter pins or similar. In yet another aspect, one or more Hooks and loops straps are attached/bonded onto both the side wall and end wall of said enclosure. In another aspect, said frame is secured to a gurney, bed or surface.

Other features and advantages of the present invention will become apparent upon examining the following detailed description of an embodiment thereof, taken in conjunction with the attached drawings.

Figure 1:
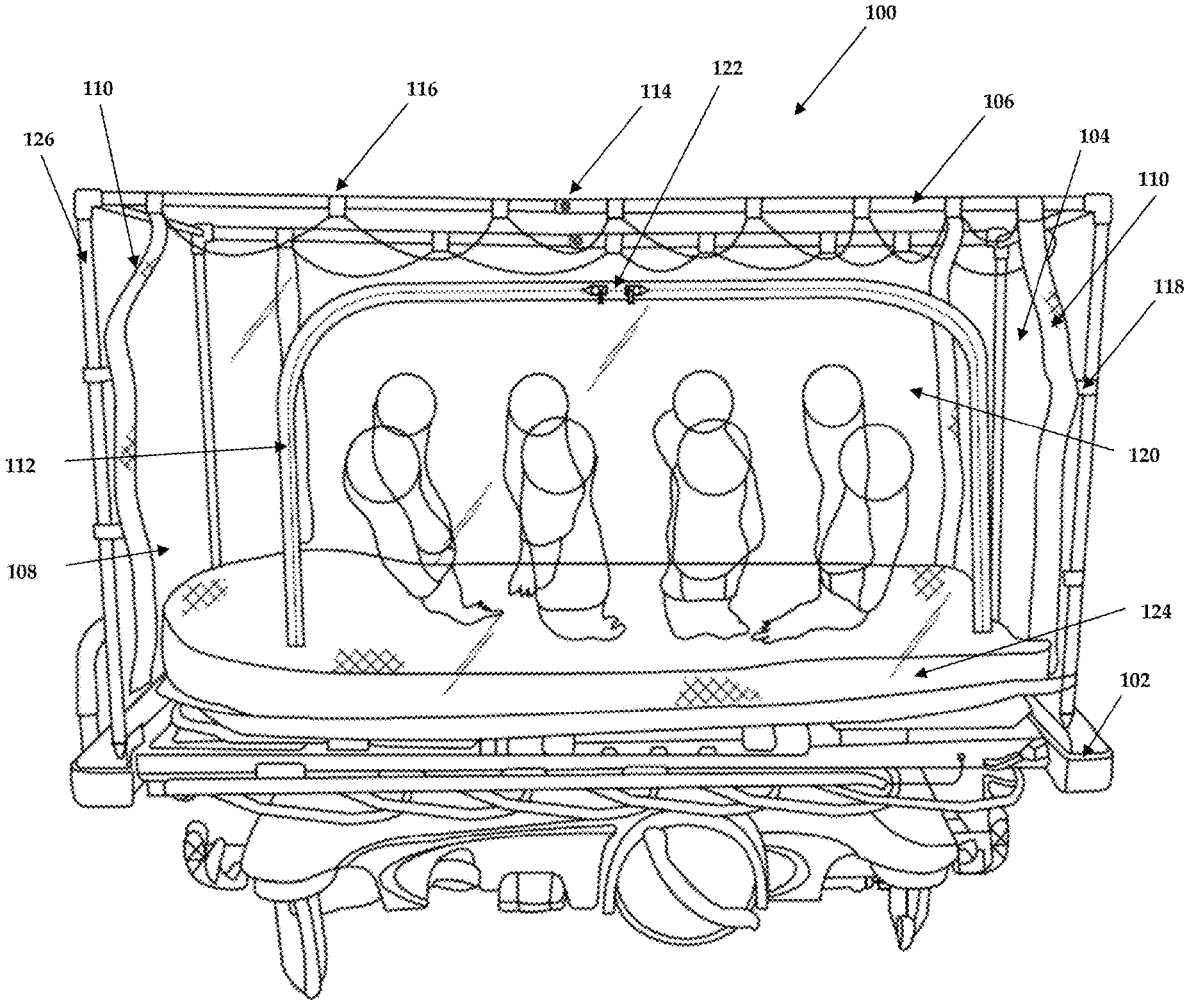
FIG. 1 is a side view of a disposable bio-secure environmental unit on top of a hospital gurney, according to an exemplary embodiment of the invention.

The above-described and other features will be appreciated and understood by those skilled in the art from the following detailed description, drawings, and appended claims.

DETAILED DESCRIPTION OF THE INVENTION

This section is for the purpose of summarizing some aspects of the present invention and to briefly introduce some embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

The present invention is generally shown, a disposable bio-disposable environmental unit (FIG. 1) (DBEU) 100 for the transporting/temporary housing of patients. The unit is based on an adjustable frame 106 that is designed to securely attach, lay or fit onto a gurney, bed, table, slab or other suitable support surface 102. The adjustable frame 106 supports and is attached to a containment tent or enclosure 104 along the 'edges' of the volume formed by the enclosure 104, positioned and secured in place on top of a support surface (such as a gurney 102), so that the patient may lay on a mattress placed inside the enclosure 104 volume. (Again, while shown positioned on a gurney 102 it may also be so positioned on a stretcher, hospital bed, or other structure constructed to receive the cabin or frame 106 or the like).

Figure 2:
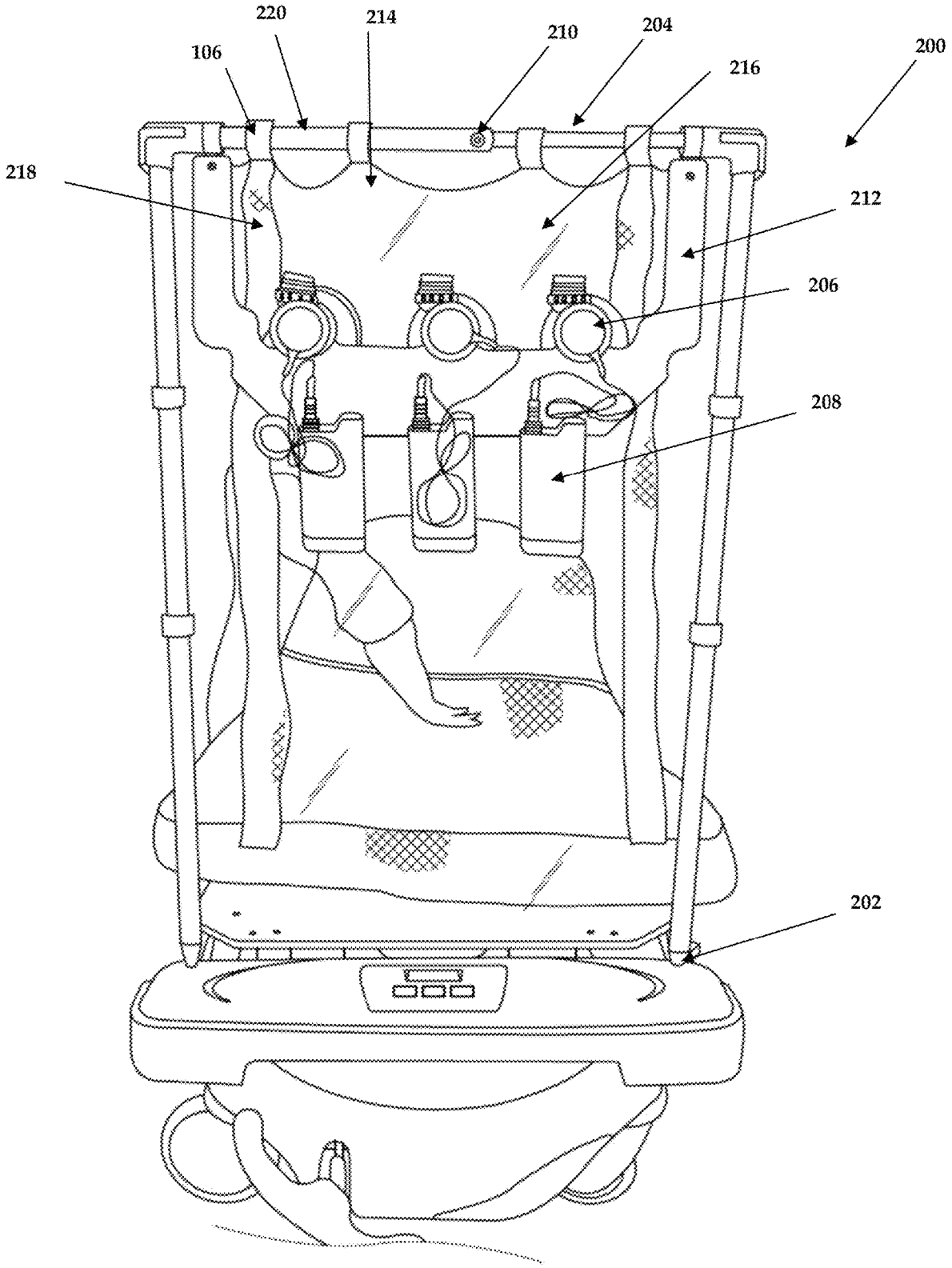
FIG. 2 is a view of an end a disposable bio-secure environmental unit on top of a hospital gurney, according to an exemplary embodiment of the invention.

In one embodiment, the adjustable dimension rigid frame 106 integrates onto a stretcher, bed, platform or gurney 102. In one embodiment 400 (FIG. 4), this is done by placing the frame base 402 onto receivers 202, 404 (FIG. 2/FIG. 4) that are fitted onto the bed, stretcher or other available and fitted out platform. The containment enclosure 104 is a disposable sealed enclosure, in one embodiment built of a 20-mil clear poly (or similar). The enclosed volume within said enclosure 104 has a 404, sidewalls 108, end walls 214 and ceiling 204, all easily secured onto the frame side members 106 and end cross member 220. The bottom of the enclosure is preferably filled with a mat/pad/mattress 124 placed for the patient inside the enclosure 104.

The bag, tent or enclosure 104 is supported by the external frame 106 via multiple mechanical attach components (e.g. Hooks and loops (such as VELCRO) straps, rope, clips, carabiners clips, etc. 116/118) located along length/width/height of the enclosure 104 to couple along the length/width/height of the frame members. These mechanical attach components may be Hooks and loops straps, rope, clips (to suitable openings within the bag edge) or any other suitable easy on/off attachment component.

In one embodiment, there is a length adjustment member 114/210 at each of the frame's upper lengths (one on each side) so that the frame overall length (along the bed side) can be adjusted when installing the frame base 402 into the receivers 202/404 on the gurney or bed. In one embodiment, the sliding of one tube within the other is controlled by a friction component, such as with the addition of an Allen set screw in an opening between the inner and outer tube, so that insertion of the set screw creates friction. In another embodiment, this may be accomplished by a set pin or via a rotating friction sleeve or similar device.

Figure 4:
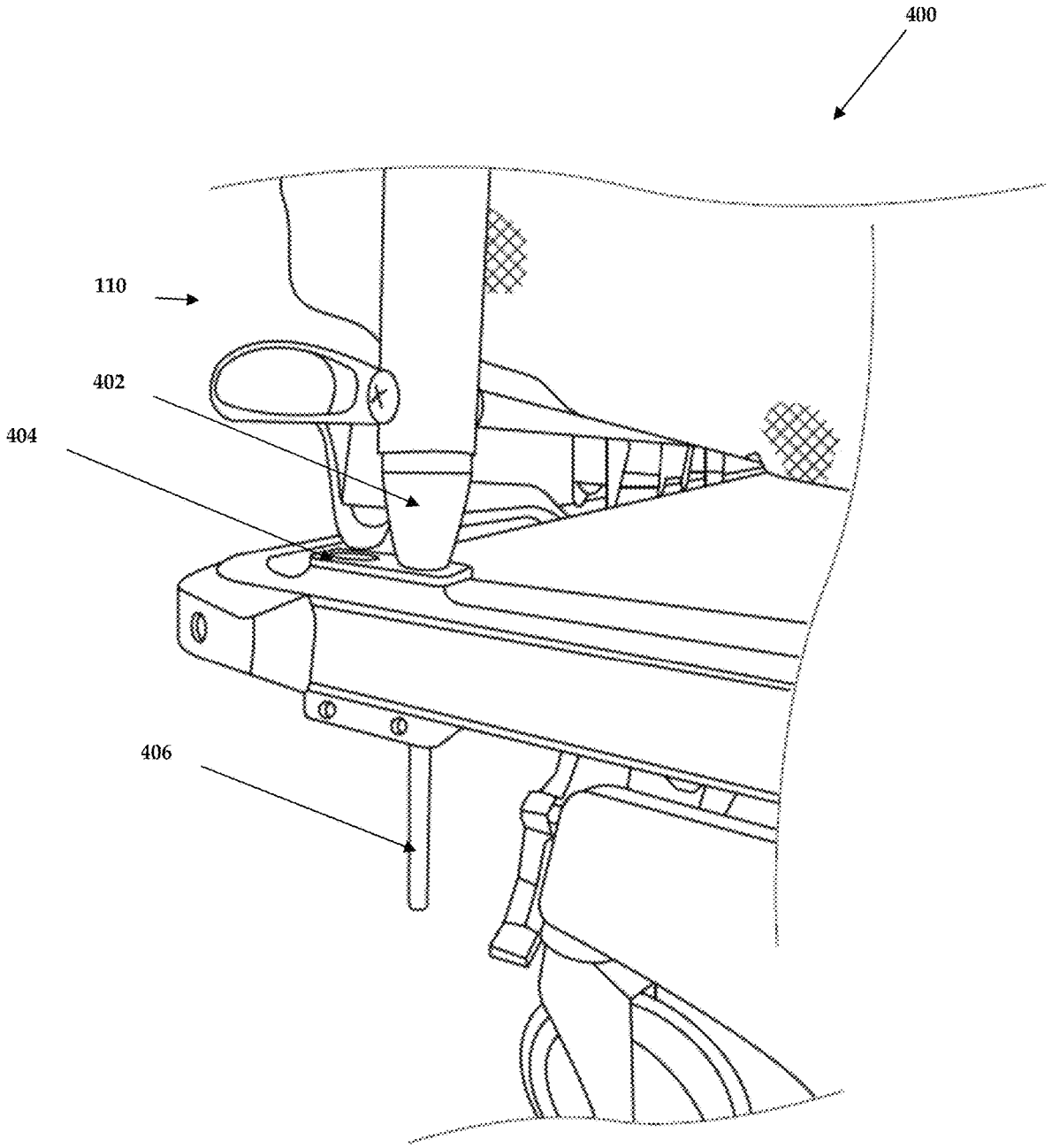
FIG. 4 is a detail view of a proposed frame interface to a gurney, according to an exemplary embodiment of the invention.

As seen in FIG. 4, all or portions of the frame 406 coming across said receiver, so that all or portions of it may then be secured (either via friction, set screws or pins, such as cotter pins). Similarly, there is a width adjustment mechanism through the presence of a width adjustment member 114/210, similarly equipped so that once the proper width is obtained, the distance may be secured via securing components such as friction and/or pins. Finally, in one embodiment, each of the unit's legs 118 may be equipped with similar adjustment/securing components, so as to adjust the overall height of the frame with relation to said gurney, surface or bed. In one embodiment, the securing component is available only on one member, with the opposite member being able to freely slide.

Access into the interior of the enclosure unit 104 is accomplished through a number of resealable openings. The two primary ones are the patient entry/exit opening 112, which is formed by an inverted 'U' (∩) shape formed by a resealable edge (a zipper, Hooks and loops or other similar resealable 'tongue'). Such a shape has the advantage of 'sticking out' with the interior of the unit as the patient is placed into the enclosure 104, so that any contact with the patient (through sweat, skin, blood or any other patient fluid) will result on the infected area of the enclosure remaining towards the interior/patient volume.

Figure 3:
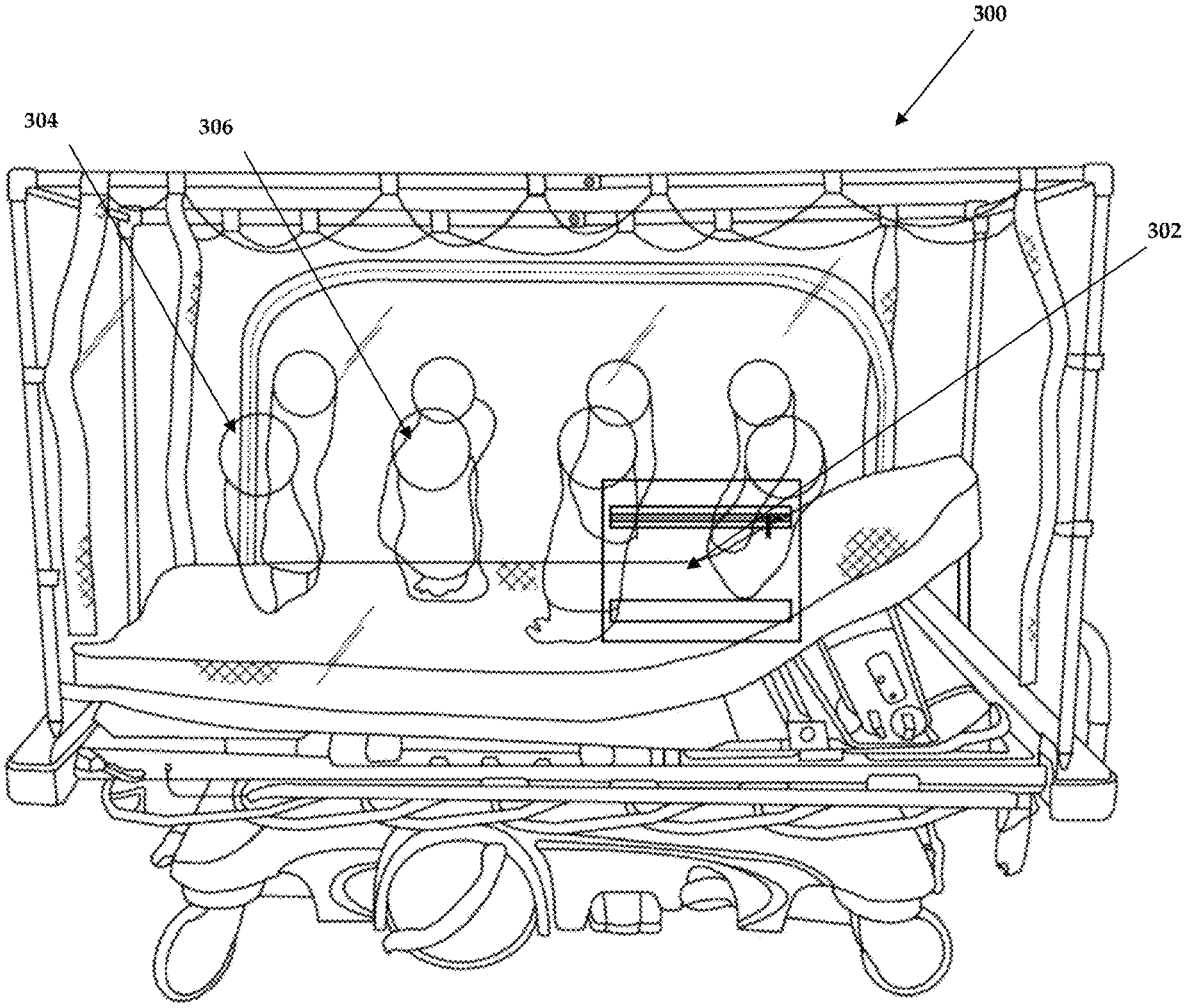
FIGS. 3 and 8 are side views of a disposable bio-secure environmental unit on top of a hospital gurney, according to an exemplary embodiment of the invention.

One or more additional entry points 302 are similarly configured so that outside caregivers may pass food/fluid/supplies/diapers/medications or other items from the outside to the patient and/or in another direction. These entry points 302 (FIG. 3) may be located anywhere along the side walls 108 and/or the bottom/end walls 216. In addition to the entry points, there may be one or more pairs of integrated sealed port glove access points 304/306, provided for patient care processes by personnel outside the enclosure 104.

Smaller versions of these ports would be provided for monitoring cables, oxygen and IV tubing. In one embodiment, an integrated IV bag holder is provided inside the enclosure 104. Alternatively, openings for fluid entry into the enclosure 104 may be provided.

A critical function of any DBEU device is the ability to adjust the positive/negative air pressure within the unit's enclosure 104. This is accomplished by the integrated battery powered 208 negative or positive pressure ventilation units 206, which go through the enclosure wall at either pre-drilled openings and or may simply plug into the enclosure material. These units are equipped with High Efficiency Particulate Air (HEPA) filtered exhaust. In one embodiment, such a setup with 3 units 206 would result in an air flow rate resulting in 13.1 changes of interior volume air per hour and minimum interior negative pressure of −3 inches of water column.

Figure 5:
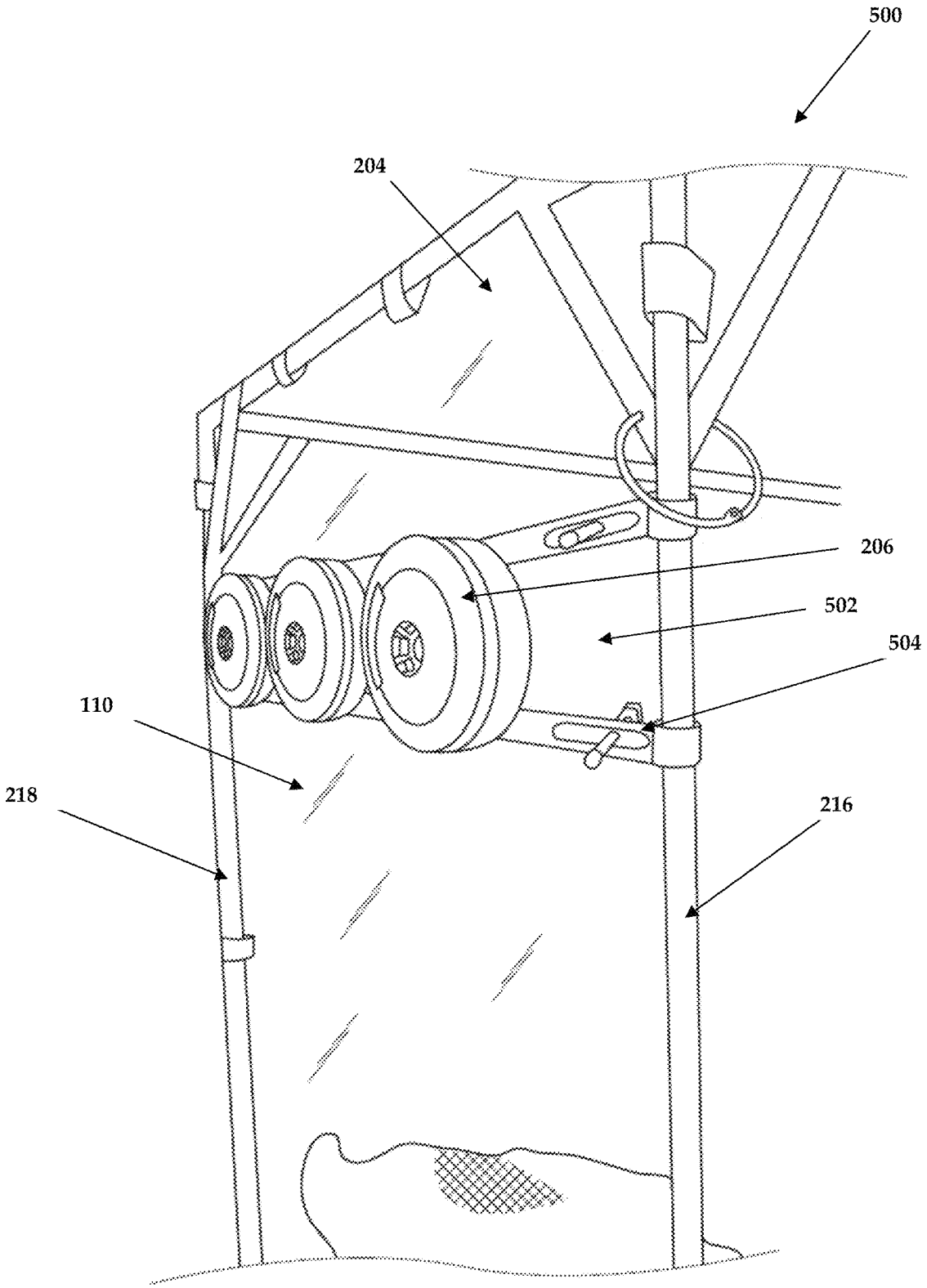
FIG. 5 is a view of fans mounted on the end of a disposable bio-secure environmental unit on top of a hospital gurney, according to an exemplary embodiment of the invention.
Figure 6:
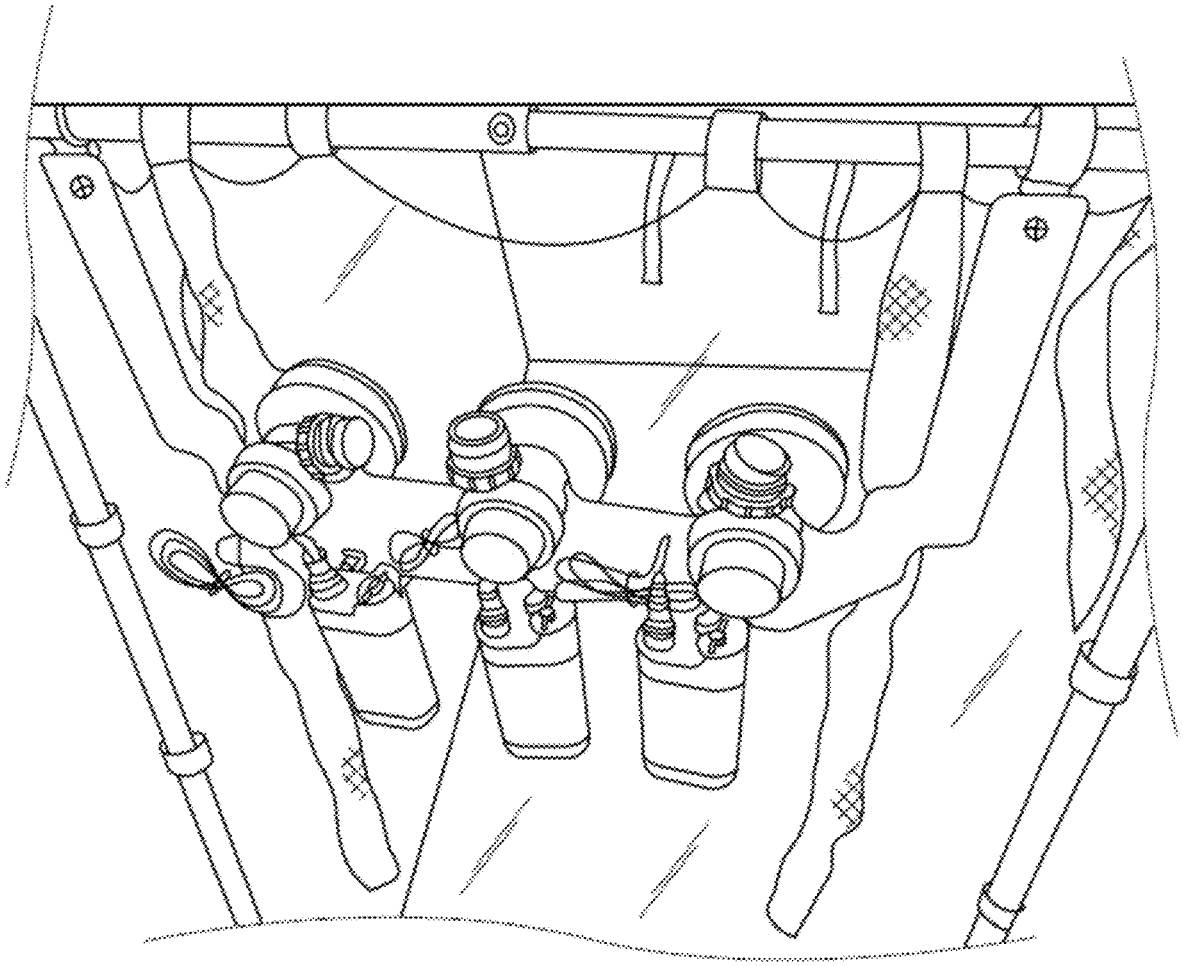
FIG. 6 is another view of the fans and batteries mounted on the end of a disposable bio-secure environmental unit, according to an exemplary embodiment of the invention.
Figure 7:
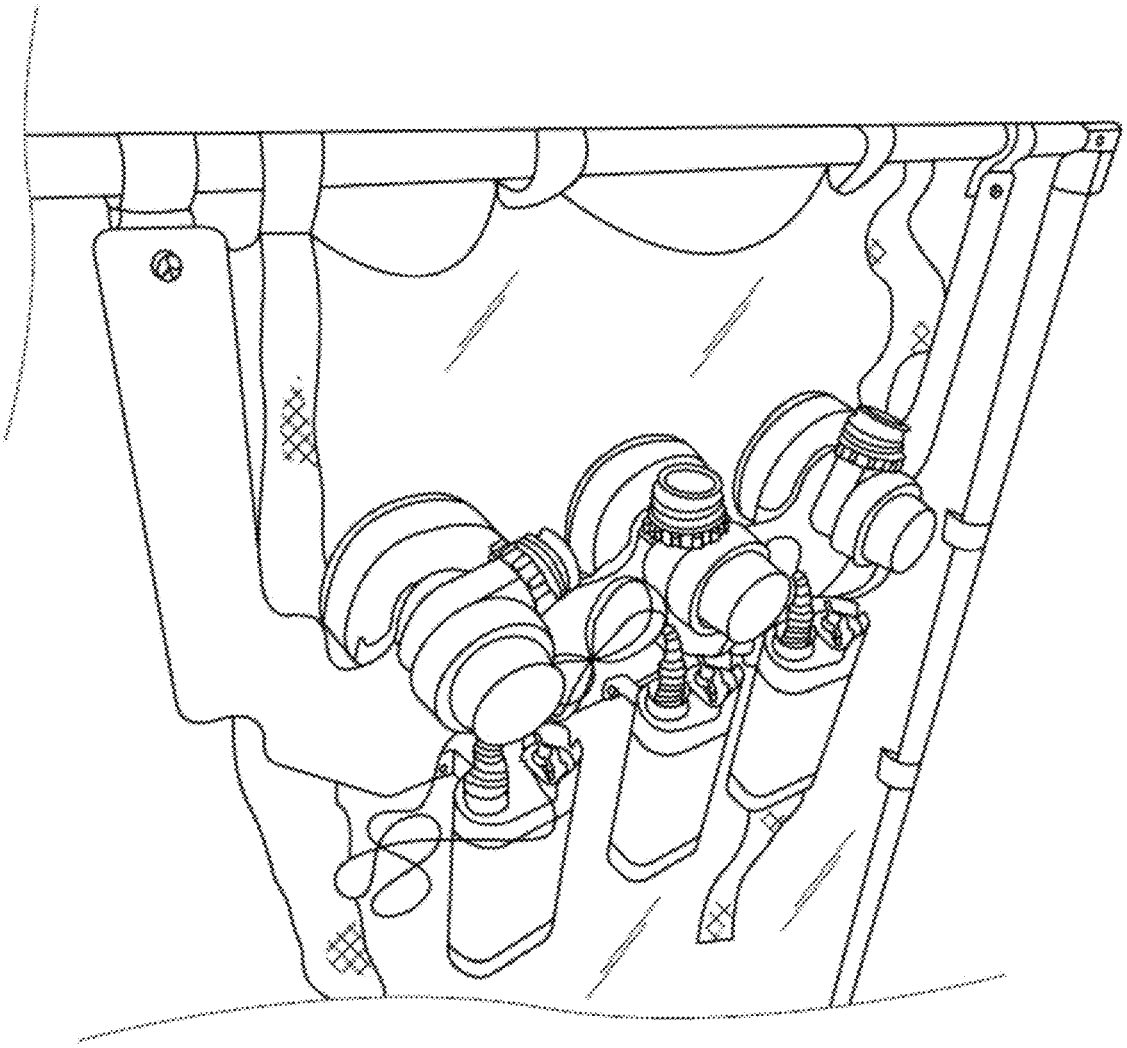
FIG. 7 is another view of the fans and batteries mounted on the end of a disposable bio-secure environmental unit, according to an exemplary embodiment of the invention.
Figure 8:
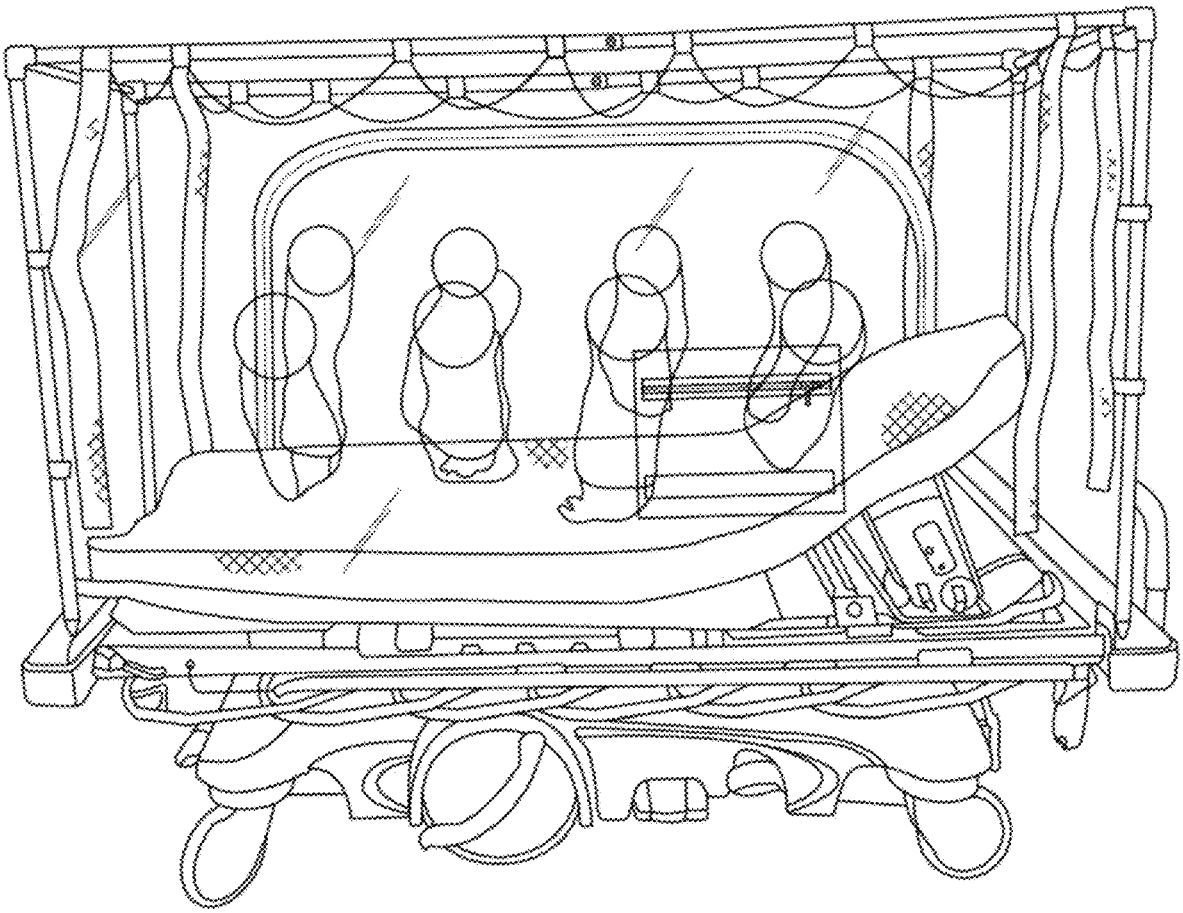
Figure 9:
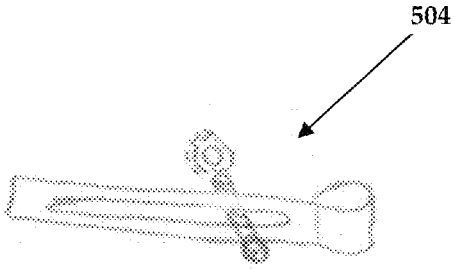
FIG. 9 shows details of a sliding bracket for the fan mount, according to an exemplary embodiment of the invention.
Figure 10:
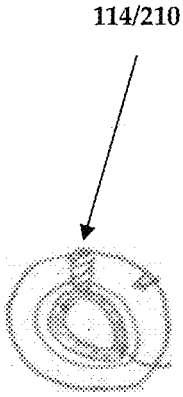
FIG. 10 shows a cross-section of the length adjustment member, according to an exemplary embodiment of the invention.
Figure 11:
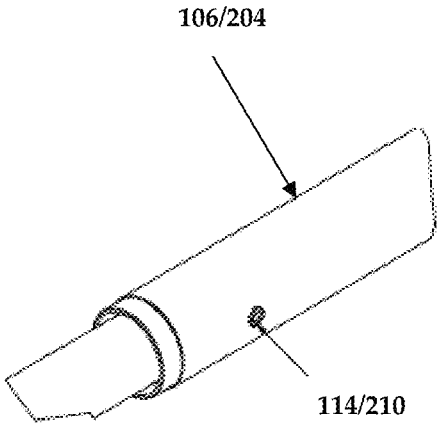
FIG. 11 shows a detail view of the length adjustment member, according to an exemplary embodiment of the invention.

In one embodiment 200, the ventilation units 206 are supported on a frame 212 hanging from the top cross member 214, so that when the overall length of said member 214 (which determines the width of the frame 104) is adjusted, the frame 212 simply slides along said member 214. In another embodiment 500, the ventilation units 206 are mounted on a sliding frame 502 attached to the vertical frames 216/218, so that as the length of the top cross member 214 is adjusted (via the adjustment component 114/210) the sliding frame 502 complies (FIG. 5). In another embodiment, this is accomplished by mounting the fixed length frame 502 on sliding brackets 504.

Figure 12:
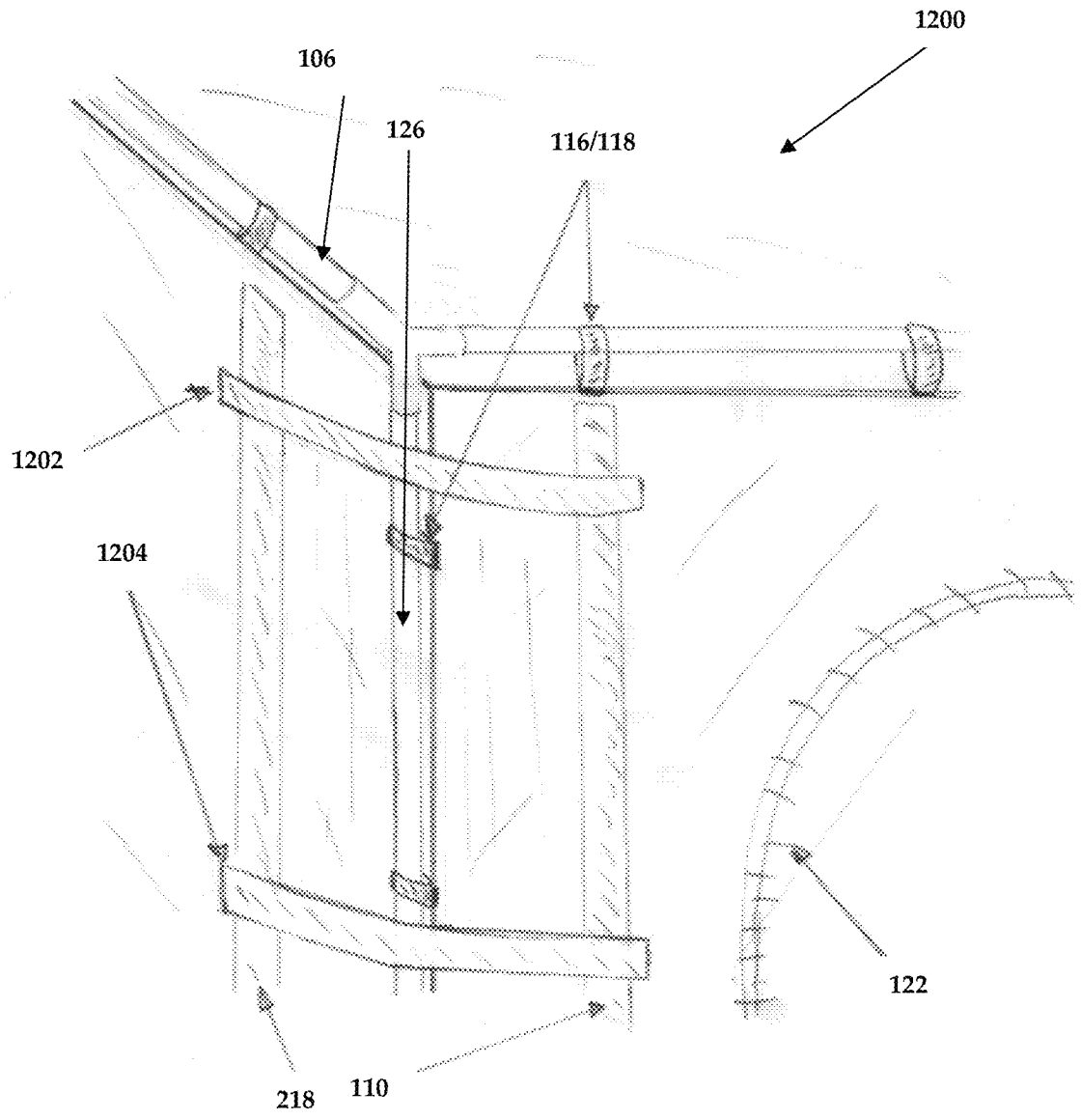
FIG. 12 shows a detailed view of the negative pressure adjustment strap for the enclosure, according to an exemplary embodiment of the invention.

Referring to FIG. 12, we see an embodiment of a feature of the enclosure 104 that is particularly beneficial when dealing with negative pressure situations (such as those required for treatment of patients infected with Ebola or COVID). The enclosure 104 forms a pneumatically sealed volume, attached to the frame 106 via the suitable mechanical attach components 116/118. These components are either part of the enclosure, or attached/bonded to it. In this fashion the enclosure 104 hangs/floats suspended from the frame 106, and its lower surface is held down via the mattress 124 which has the patient lying in it, inside the enclosure 104.

All positive pressure applications will have the enclosure 104 balloon until it meets or slightly exceeds the enclosure dimensions 104, which will be sized to the frame 106. A major situation is encountered when negative pressure is required. In effect, the atmospheric pressure would push onto the enclosure 104, potentially shrinking it. To counter some of these effects, Hooks and loops strips 110/218 are attached/bonded to the walls of the enclosure 104 are used. By securing these strips 110/218 to each other across the frame member 126 that separates them with one or more horizontal strips 1202/1204, the skin of the walls will be stretched and kept from suctioning itself in, resulting in a larger internal volume for the patient/caregivers. This procedure may also be used for the enclosure ceiling 204 both at the corners and/or the center, again, ensuring the comfort of the patient.

Figure 13:
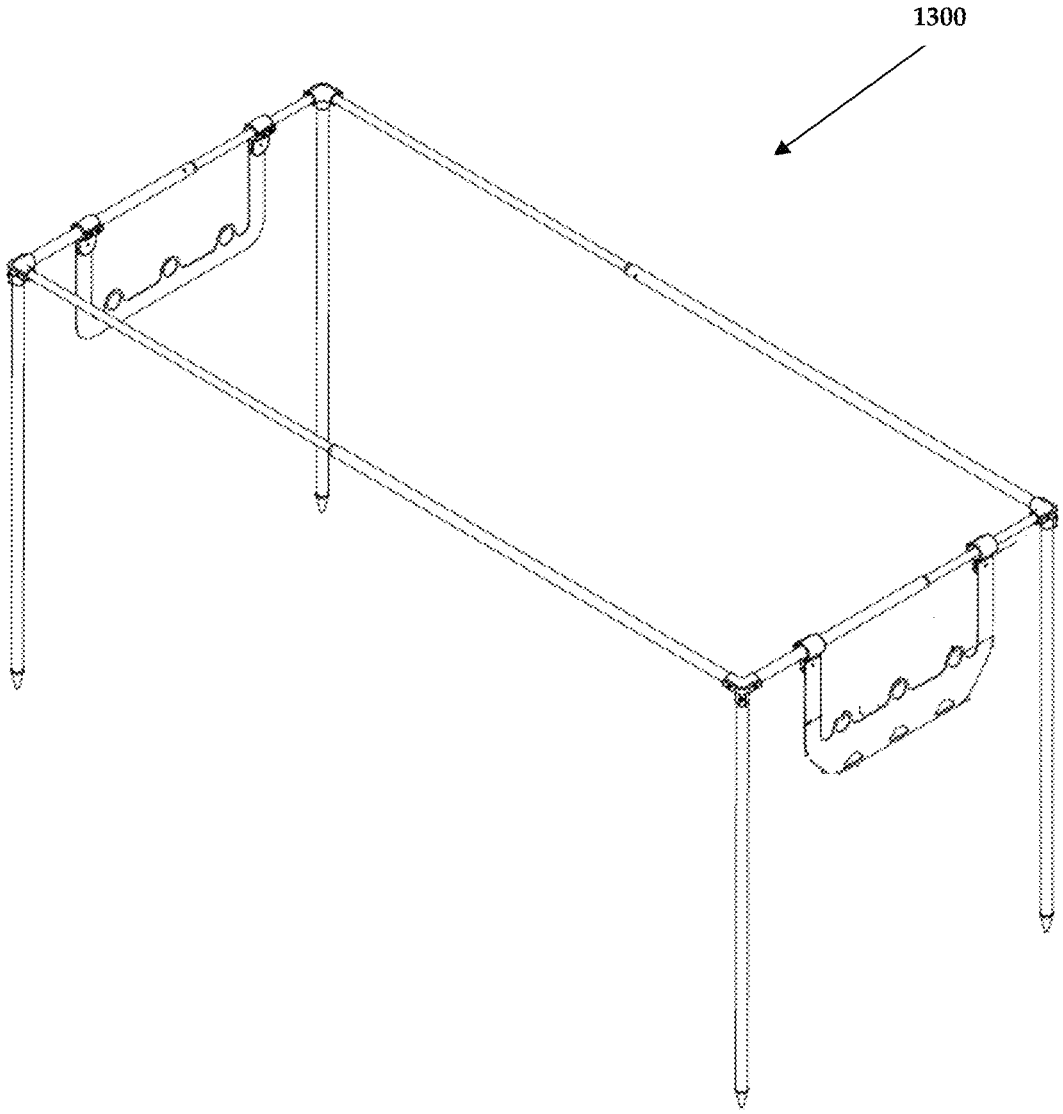
FIG. 13 shows a detailed isometric view of the frame, according to an exemplary embodiment of the invention.
Figure 14:
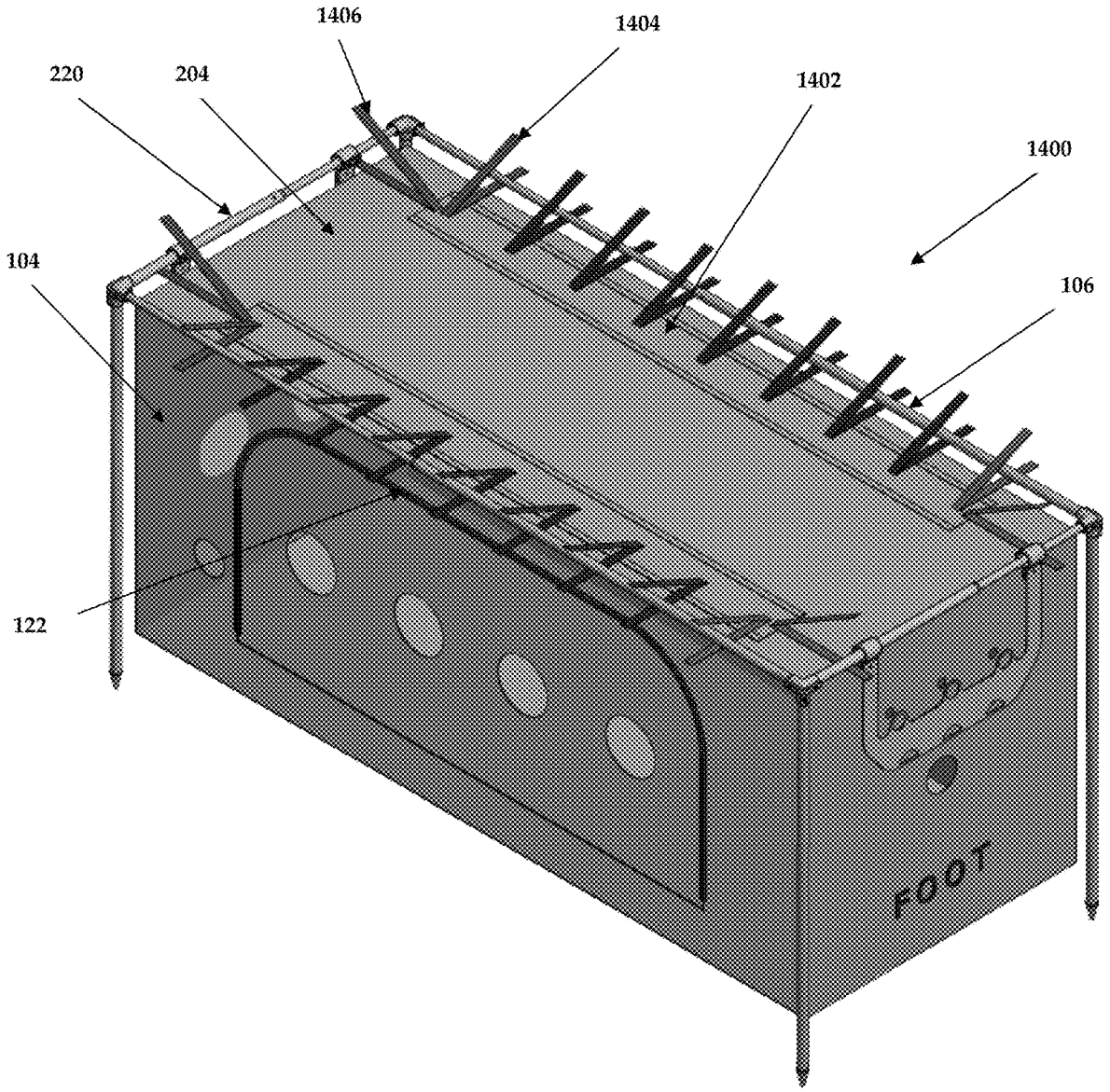
FIGS. 14-15 show detailed views of the negative pressure adjustment straps for the ceiling of the enclosure, according to exemplary embodiments of the invention.

Referring to FIG. 13, we see 1300 the frame of the DBEU 100 inside which the enclosure 104. In one embodiment, when negative pressure will be used (similar to 1200 in FIG. 12) an alternate top arrangement may be used to place the roof/ceiling 204 of the enclosure 104 in tension. As seen in FIG. 14, we use 1400 a Hooks and loops strip 1402 attached to the outside of the enclosure ceiling 204 along the length of said ceiling, which is then laced to Hooks and loops straps along both the side 1404 and the ends 1406 along the frame side members 106.

Figure 15:
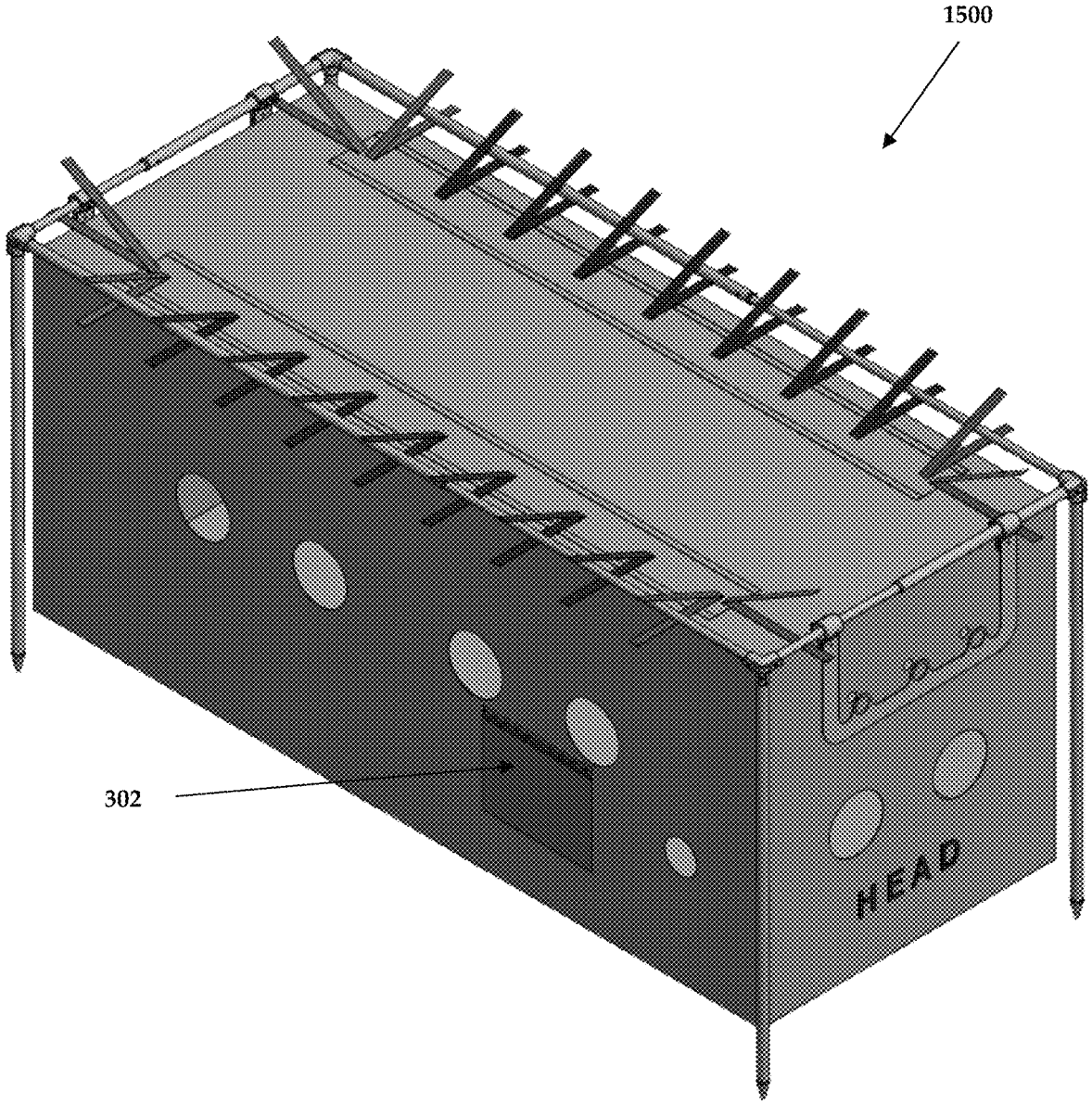

In FIG. 15, we see the other side, with particular focus on the access

Example

Perhaps an example of the use and operation of the Environmental Unit helps understand its unique capabilities. Firstly, the person setting up the Environmental Unit (Dr., Nurse, Technician, or other trained person assembles the: transport monitor and cords; blood pressure cuff; ECG electrodes (for chest); Pulse Ox probe; oxygen tubing; nasal canula; and IV tubing (if needed).

Next the cords are placed by: opening one or more of the access openings 302, pulling the lining outward; thread monitoring cords through the appropriate port or opening 302; twist the lining around the cords; tape the lining to the cords forming a seal; push the cords and lining inward; ensure all monitoring probes are connected to cords; repeat process for Oxygen and IV tubing on the same or another opening 302.

The gurney, already prepared with an Environmental Unit, is opened by: downwardly unzipping the one or more zippers 122 located on the entry/exit opening and having covers 112 which ensures when opened, the flap 120 is lowered so that the patient may only contact the portions of the flap that will face the inside of the enclosure 104.

Next, the status of the batteries 208 is checked, and if necessary, they are replaced. The ventilation units are tested 206, and made ready for operation. The isolation Gurney is now ready for use for a patient. The patient should have been or should now be Informed of the use of the Isolation transport unit in order to facilitate transport to an isolation unit.

The patient should next enter the isolation gurney through the entry 120. Closing the isolation containment enclosure 104 closure is accomplished by grabbing the closure zipper 122, closing it and if necessary, sealing the zipper with additional covers 122 having Hooks and loops strap, strip or tape. In one embodiment (FIGS. 15-16), the zipper 122 is double pull, so it may be closed/opened both from the inside and the outside.

The other entries 302 are available in the event a patient needs additional supplies. In one embodiment, these openings are double sealed, so that no air may escape/enter as objects are passed into the enclosure 104 interior. This is accomplished by a double zippered opening. When passing something inside, the process begins by opening the outside zipper to the transfer pocket. The object is placed into the pocket the pocket is zipped closed. The patient thereafter unzips the inside pocket and can obtain the item; thereafter zipping the pocket closed. It is important to ensure that the patient zips the inside pocket closed.

Figure 16:
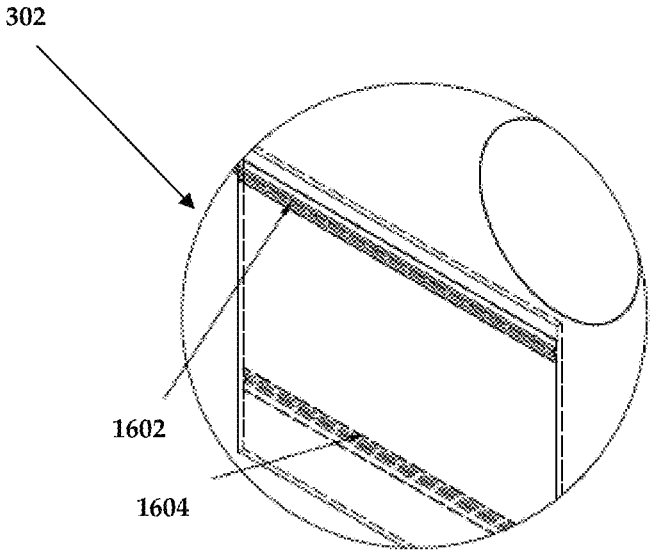
FIG. 16 shows a detailed view of the side access hatch for the enclosure, according to an exemplary embodiment of the invention.

As seen in FIGS. 15-16, the access entry 302 may be done with simple zippers and Hooks and loops covers. In one embodiment, the entry 302 has pockets having zippers inside 1602 and outside 1604 to allow access both from the inside and the outside.

CONCLUSION

In concluding the detailed description, it should be noted that it would be obvious to those skilled in the art that many variations and modifications can be made to the shown embodiments without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "exemplary embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the foregoing description of embodiments.

The invention claimed is:

1. A disposable bio-secure environmental unit comprising:

a reusable support frame adjustable in length and/or width;

a collapsible containment enclosure having a ceiling, a bottom and at least four side panels forming a single pneumatic enclosure, said containment enclosure having one or more mechanical attach components along its length/width/height for coupling with said support frame;

said containment enclosure having one or more resealable entry/exit/access openings;

one or more battery powered negative pressure ventilators mechanically attached to said frame, one or more of said ventilators having pneumatic access to said containment enclosure's interior volume;

wherein one of said containment enclosure's resealable entry/exit/access openings extends along a side and top of one side panel of said enclosure, forming a flap when opened, so that said flap falls over the side when open; and said containment enclosure includes one or more pairs of integrated sealed port glove access points.

2. The environmental unit of claim 1 wherein:

said containment enclosure has an internal height that is approximately half of an internal length of said containment enclosure.

3. The environmental unit of claim 2 wherein:

said containment enclosure's one or more mechanical attach components are comprised of one or more of:

hooks and loops straps, ropes, clips, loops, or carabiners clips; and said enclosure has overall frame length or width length extension control components comprised of one or more of:

set screws, friction couplers or cotter pins.

4. The environmental unit of claim 3 wherein:

one or more of said hooks and loops straps are attached/bonded onto both a side wall and an end wall of said enclosure.

5. The environmental unit of claim 4 wherein:

said frame is secured to a gurney, bed or surface.

6. The environmental unit of claim 1 wherein:

said containment enclosure's one or more mechanical attach components are comprised of one or more of:

hooks and loops straps, ropes, clips, loops, or carabiners clips; and said enclosure has overall frame length or width length extension control components comprised of one or more of:

set screws, friction couplers or cotter pins.

7. A method of using a disposable bio-secure environmental system, said method comprising:

providing a reusable support frame adjustable in length and/or width;

installing a collapsible containment enclosure having a ceiling, a bottom and at least four side panels forming a single pneumatic enclosure, said containment enclosure having one or more mechanical attach components along its length/width/height for coupling with said support frame;

wherein said containment enclosure has one or more resealable entry/exit/access openings as well as one or more battery powered negative pressure ventilators mechanically attached to said frame, one or more of said ventilators having pneumatic access to said containment enclosure's interior volume;

wherein said containment enclosure's one or more resealable entry/exit/access openings extends along a side and top of one said enclosure's side panel, forming a flap when opened, so that said flap falls over the side when open; and said containment enclosure includes one or more pairs of integrated sealed port glove access points.

8. The method of claim 7 wherein:

said containment enclosure has an internal height that is approximately half of an internal length of said containment enclosure.

9. The method of claim 7 wherein:

one or more of said hooks and loops straps are attached/bonded onto both a side wall and an end wall of said enclosure.

10. The method of claim 9 wherein:

said containment enclosure's one or more mechanical attach components are comprised of one or more of:

hooks and loops straps, ropes, clips, loops, or carabiners clips; and said enclosure has overall frame length or width length extension control components comprised of one or more of:

set screws, friction couplers or cotter pins.

11. The method of claim 10 wherein:

said frame is secured to a gurney, bed or surface.

12. The method of claim 11 wherein:

one or more of said hooks and loops straps are attached/bonded onto both the side wall and the end wall of said enclosure.

13. The method of claim 7 wherein:

said containment enclosure's one or more mechanical attach components are comprised of one or more of:

hooks and loops straps, ropes, clips, loops, or carabiners clips; and said enclosure has overall frame length or width length extension control components comprised of one or more of:

set screws, friction couplers or cotter pins.

* * * * *